US005802798A

United States Patent [19]

Martens

[11] Patent Number: 5,802,798

[45] Date of Patent: Sep. 8, 1998

[54] SET OF BUILDING ELEMENTS FOR FRAMEWORK STRUCTURES

[75] Inventor: Christian Martens, Cologne, Germany

[73] Assignee: Expo Mart Inc., Wilmington, Del.

[21] Appl. No.: 753,415

[22] Filed: Nov. 25, 1996

[30] Foreign Application Priority Data

Nov. 25, 1995 [DE] Germany ..... 195 44 076.5

[51] Int. Cl.[6] ..... E04H 12/00

[52] U.S. Cl. ..... 52/653.1; 52/649.6; 403/171

[58] Field of Search ..... 52/646, 648.1, 52/649.3, 649.4, 649.6, 81.1; 403/171, 172, 169, 217

[56] References Cited

U.S. PATENT DOCUMENTS

| | | | |
|---|---|---|---|
| 2,931,467 | 4/1960 | Fentiman | 189/34 |
| 3,351,313 | 11/1967 | Guillon | 248/246 |
| 5,082,128 | 1/1992 | Franzen et al. | 212/266 |
| 5,101,607 | 4/1992 | Staeger | 52/646 |
| 5,356,234 | 10/1994 | VanGool | 403/171 X |

FOREIGN PATENT DOCUMENTS

| | | |
|---|---|---|
| PS 98 330 | 6/1973 | Germany . |
| A-36 44 096 | 7/1988 | Germany . |
| 38 00 547 | 7/1989 | Germany . |
| 38 42 726 | 6/1990 | Germany . |
| 88 16 884.0 | 3/1991 | Germany . |
| OS-24 57 674 | 6/1996 | Germany . |

*Primary Examiner*—Carl D. Friedman
*Assistant Examiner*—Creighton Smith
*Attorney, Agent, or Firm*—Baker & Daniels

[57] ABSTRACT

Set of structural elements for producing supporting structures, having supporting bars 5 and cylindrical connecting elements 1 for insertion heads 6 provided on the end sides of the supporting bars 5, the connecting elements being provided with a plurality of slots which are open on one side and extend, parallel to one another and to the axis of the cylindrical connecting elements, from the surface to the center, and the slots each being widened, at a distance from the radial ends of the same, to form chambers for receiving the insertion heads. The insertion heads are formed in the flat end regions of the supporting bars, at a distance from the end edges, in that at least two parallel slits are provided at an angle of 90° with respect to the end edge, and, in each case one bead running parallel to the end edge is formed in the strips produced by the slits, and the beads of adjacent strips are respectively formed on mutually opposite sides, with the result that an annular thickening with circular or oval cross section and an outer circumference which corresponds to the cross section of the chamber in the slots of the connecting elements is formed in the region of the flat ends of the supporting bars, parallel to the end side, beside a continuous border strip.

10 Claims, 5 Drawing Sheets

Fig. 1
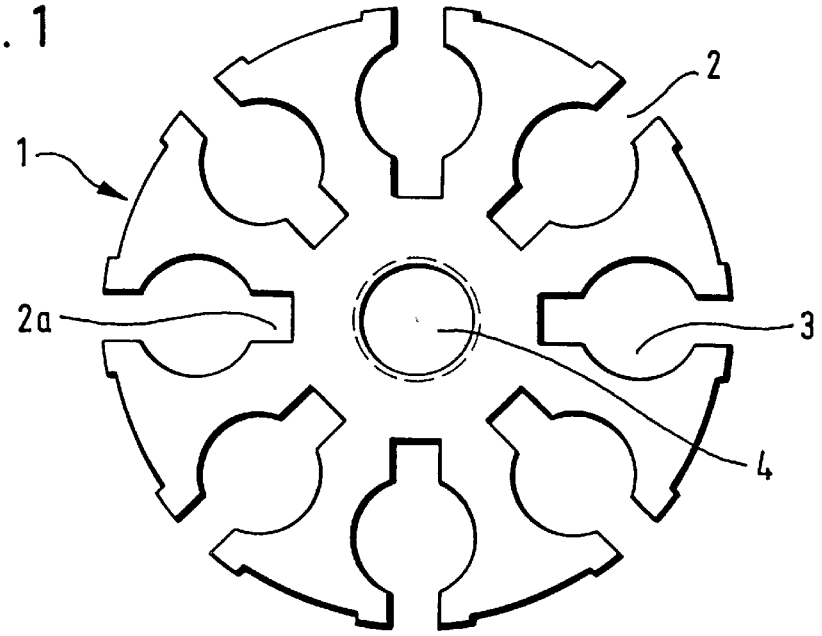
Fig. 2
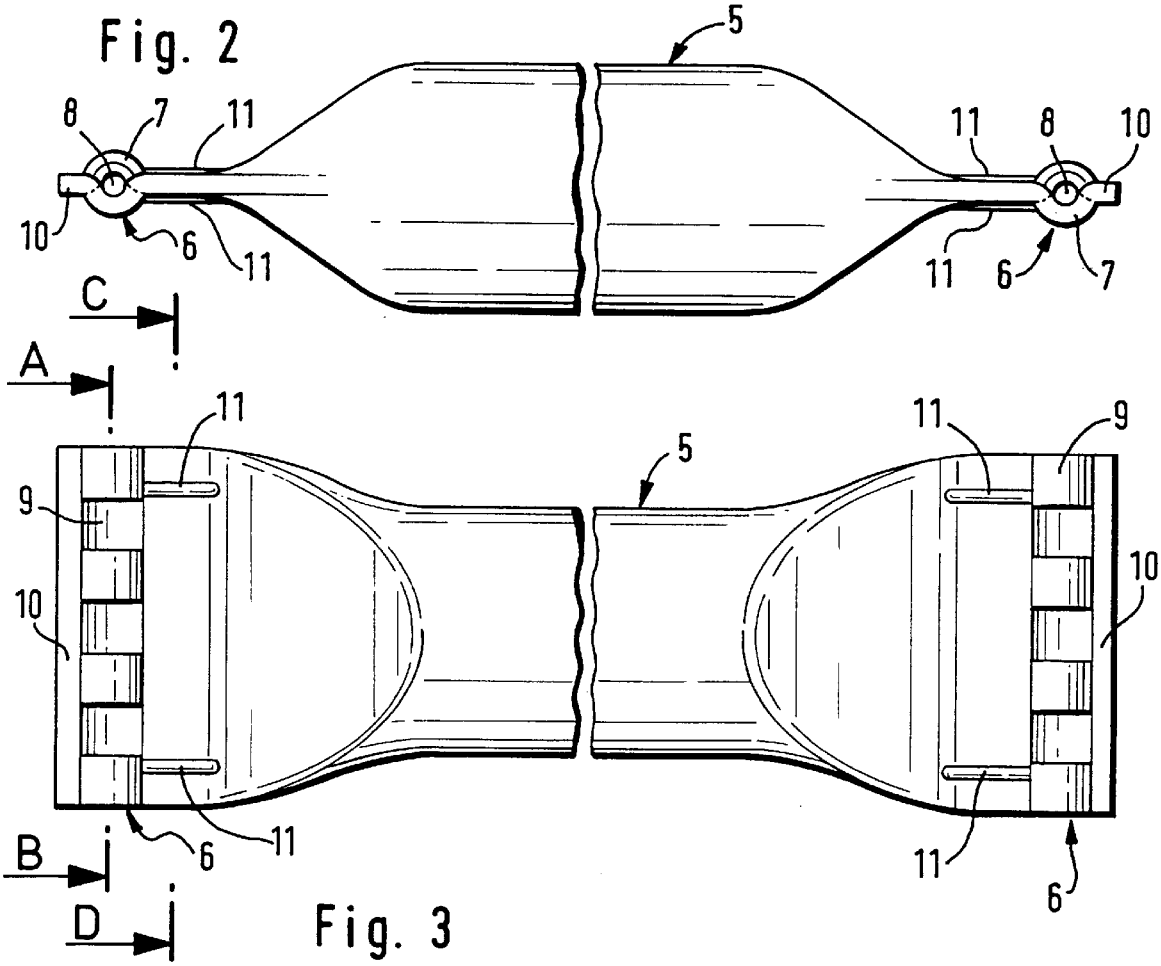
Fig. 3

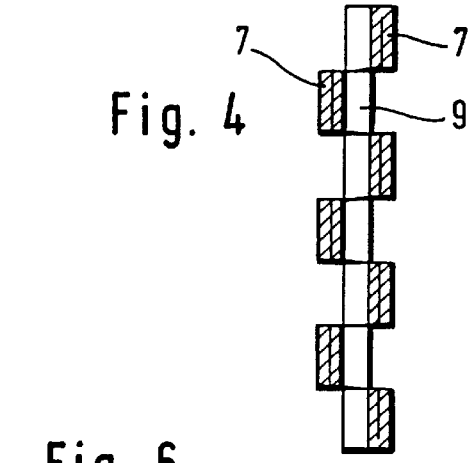
Fig. 4
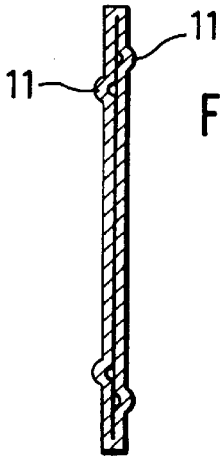
Fig. 5
Fig. 6
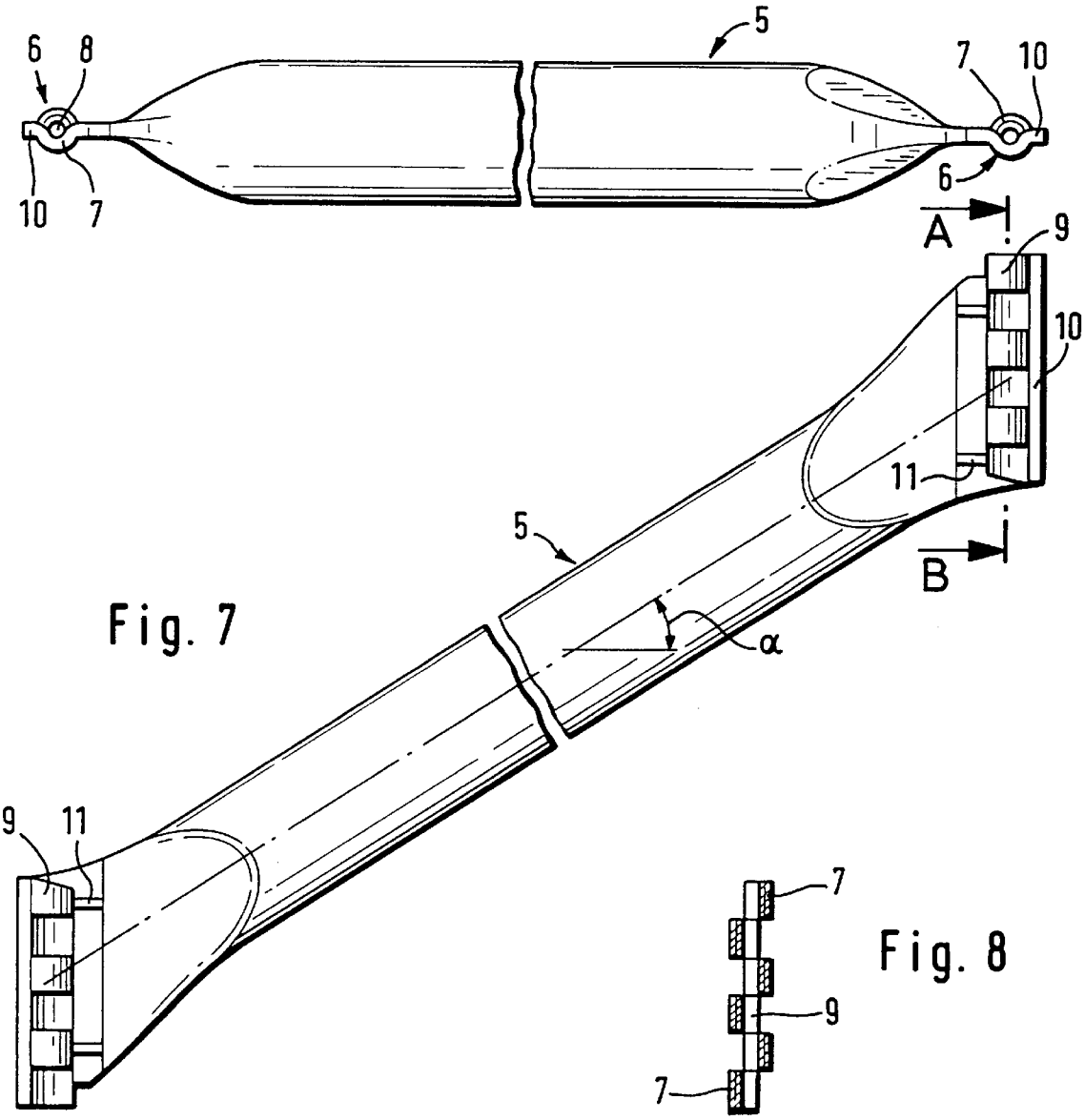
Fig. 7
Fig. 8

SET OF BUILDING ELEMENTS FOR FRAMEWORK STRUCTURES

The subject matter of the invention is a set of structural elements for producing supporting structures, having supporting bars and connecting elements for connecting the ends of the supporting bars to one another.

The various embodiments of supporting structures which can be produced from supporting bars by means of connecting elements have been known for some time now. Basic elements, for example, pyramids, can be produced from the supporting bars and connecting elements. In this case, a square base area of the pyramid is produced from 4 supporting bars, and supporting bars are used to form 4 side surfaces in the form of isosceles triangles. The respective ends of the supporting bars are held together at the tip of the pyramid by a connecting element. Basic elements of this kind can be combined to produce supporting structures which extend over relatively large surface areas and exhibit sufficient stability.

DE-OS-24 57 674 discloses a connection of sup porting bars using hemispherical junction pieces, this connection making it possible to construct supporting frameworks for scaffolding-like or skeleton-like structures. The structures not only comprise bars running at right angles to one another. In this design, the junction piece provided is a hollow hemisphere in which there are formed slots which run along great circles and in which it is possible to insert, at various angles, the ends of supporting bars provided with corresponding bolts and nuts or bolt heads. Using such connecting grooves, it is thus possible to form tetrahedral or else cubic basic elements for supporting structures which are made up of a number of such basic elements.

A set of structural elements for producing supporting structures from supporting bars and junction pieces is disclosed in German Utility Model 88 16 884 and DE-OS-38 00 547. The cylindrical junction pieces have slots which are distributed uniformly over the circumference, extend radially inward from the surface and are widened, in each case on a circle around the center axis of the junction piece, to form cylindrical chambers running parallel to one another. The slots and chambers serve to receive, with a form fit, insertion heads which are formed at the flat ends of supporting bars. The insertion heads are thickenings, in the form of cylindrical beads, which correspond to the length of the chambers and are adapted to the cross section of the chamber. They are formed by rolling in pressed-flat ends of the tubular supporting bars. However, it is also possible, for half-cylinder strips of the height of the pressed-flat regions to be rivetted on the latter or for hemispherical or oval stamped sections to be provided in these regions, on both sides in each case, such that a bead with circular cross section is produced at the end of the pressed-flat supporting bars.

Despite the form fit, there is a considerable amount of play in the positioning of the supporting bars with respect to the junction pieces, on account of the smaller diameter of the beads with respect to the chamber diameters and of the thickness of the pressed-flat regions in comparison with the width of the slots, provided that the two ends of a supporting bar are not connected to other junction pieces.

The object of the present invention is to improve further the abovedescribed, known junction pieces and insertion heads.

This object is achieved by a set of structural elements for producing supporting structures, having supporting bars and cylindrical connecting elements for insertion heads provided on the end sides of the supporting bars, the connecting elements being provided with a plurality of slots which are open on one side and extend, parallel to one another and to the axis of the cylindrical connecting elements, from the surface to the center, and the slots each being widened, at a distance from the radial ends of the same, to form chambers for receiving the insertion heads, and the insertion heads being formed at the flat ends of the supporting bars, wherein, at a distance from the end edges of the flat ends of the supporting bars, at least two parallel slits are provided at an angle of 90° with respect to the end edge, and, in order to form the insertion heads, in each case one bead running parallel to the end edge is formed in the strips produced by the slits, and the beads of adjacent strips are respectively formed on mutually opposite sides, with the result that a cross sectionally annular thickening with an outer circumference which corresponds to the cross section of the chamber in the slots of the connecting elements is formed in the region of the flat ends of the supporting bars, parallel to the end side, beside a continuous border strip.

The chambers in the slots of the connecting elements may have a circular or oval cross section. Accordingly, the annular thickenings of the insertion heads have a corresponding circular or oval cross section.

Preferably 3 to 7 strips are formed at a distance from the end edge and, thereafter, 3 to 7 beads are produced in the form of hemispherical or oval stamped sections which are respectively arranged on mutually opposite sides so as to form a bead with an approximately circular or oval cross section. Once the beads have been formed, a continuous border strip remains on the end edge of the flat ends, and this engages in that part of the slots which extends radially inward in the connecting element from the chambers.

In order to strengthen the flat end region with the insertion heads with respect to the supporting bars, one or more parallel beads may be formed, at an angle of 90° with respect to the end edge of the flat ends of the supporting bars, in the flat region between the thickening with annular cross section and that end of the flat region which is remote from the end side.

The center axis of the annular thickening is spaced apart from the end of the supporting bars, a continuous border strip being formed in the process, by a distance. This distance is slightly smaller than the distance of the center axis of the chambers from the inner ends of the slots in the connecting elements.

In order to reinforce the form-fit engagement of the insertion heads in the chambers of the connecting elements, a pin may be arranged in the duct, formed by the beads, of the annular thickening.

For the purpose of receiving the insertion heads, the connecting elements have preferably eight slots, with chambers, arranged in a rotationally symmetrical manner with respect to the axis of the connecting elements.

The connecting elements are profile parts which are cut to length and have continuous slots and chambers. The chambers and slots can be closed by disks which can be fastened, on both sides, on the end faces of the profile parts.

The fastening can take place in that the connecting elements have a continuous bore in the center. This so-called central bore may have an internal thread at least in the end regions, in the vicinity of the end faces.

In order to form supporting structures, it is preferred to have supporting bars arranged in different ways with respect to the longitudinal axis of the supporting bars. For the supporting bars which are to be arranged horizontally or vertically in the supporting structures, the insertion heads are arranged such that the annular thickenings, formed from beads, with circular or oval cross section run, in the two end regions of the supporting bars, at an angle of 90° with respect to the longitudinal axis of the supporting bars.

In another embodiment of the supporting bars, in which case the latter are to be connected to other supporting bars at an angle other than 90° with respect to the longitudinal axis, the insertion heads are formed at different angles with respect to the longitudinal axis of the supporting bars. In the case of these so-called diagonal bars, the annular thickenings, formed from the beads, with circular or oval cross section run, in the two end regions of the supporting bars, parallel to one another and at an angle a of 55° to 45° with respect to the longitudinal axis of the supporting bars.

The connecting elements may be produced from metal or plastic. Preferred metals are steel, aluminum or other corrosion-resistant metal alloys.

If the connecting elements are produced from plastic, impact-resistant polymers, which may optionally be reinforced by the insertion of fibers, are preferred. Suitable polymers are impact-resistant grades of polystyrene, polycarbonates and ABS terpolymers.

Metals such as aluminum or steel are preferred for the supporting bars.

In order to permit simple insertion of the insertion heads into the connecting elements, tolerances are set at the production stage such that the diameter or outer circumference of the annular beads of the insertion heads is always somewhat smaller than the diameter or the circumference of the chambers in the connecting slots. The flat end regions of the supporting bars are each somewhat thinner than the thickness of the slots in the connecting elements. The differences in thickness may be in the range from a few tenths of a millimeter up to one millimeter, and in some circumstances even up to two millimeters. The length and diameter of the supporting bars are selected such that the desired connecting strength of the supporting bars is achieved. If tubes are used as supporting bars, the wall thickness is selected correspondingly. In such a case, the flat end regions can be produced simply by pressing the tubes flat.

The invention will now be described in more detail with reference to the figures, in which:

FIG. 1 shows a cross section through a connecting element,

FIG. 2 shows an elevational view of a supporting bar,

Figure 9:
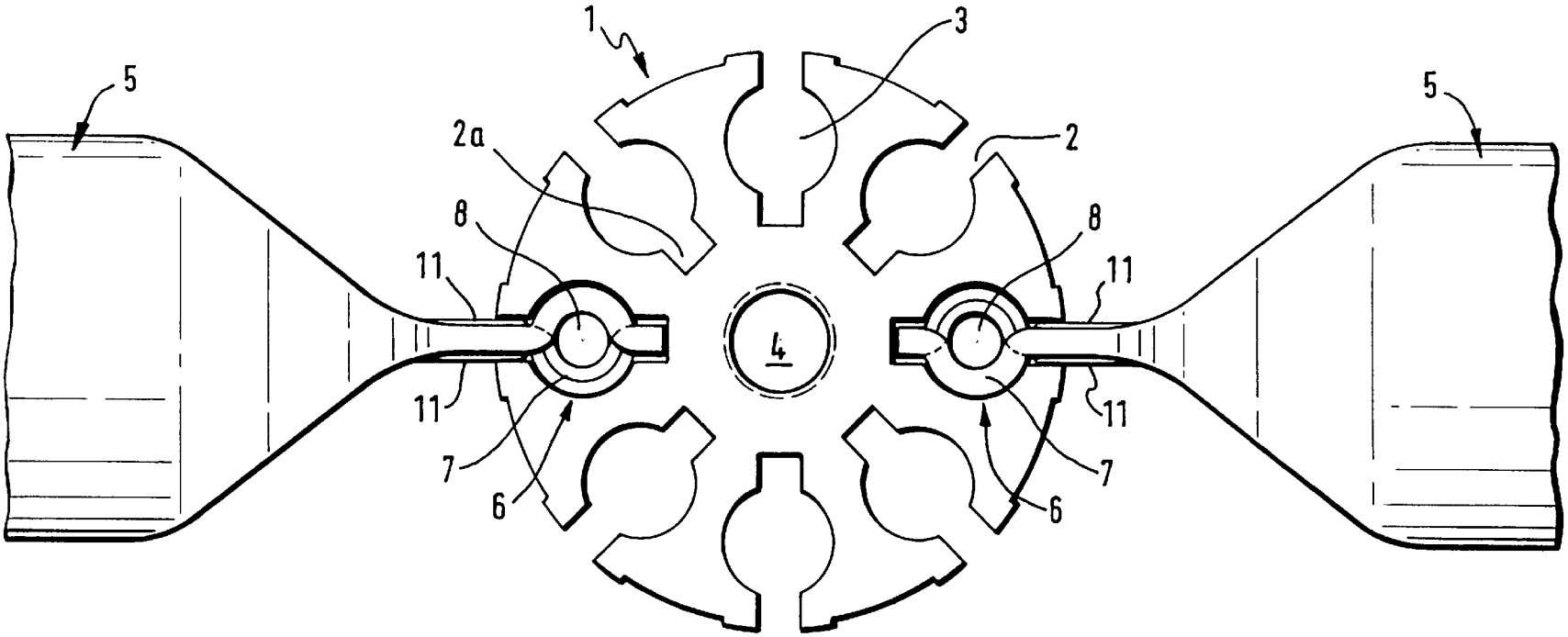
Figure 10:
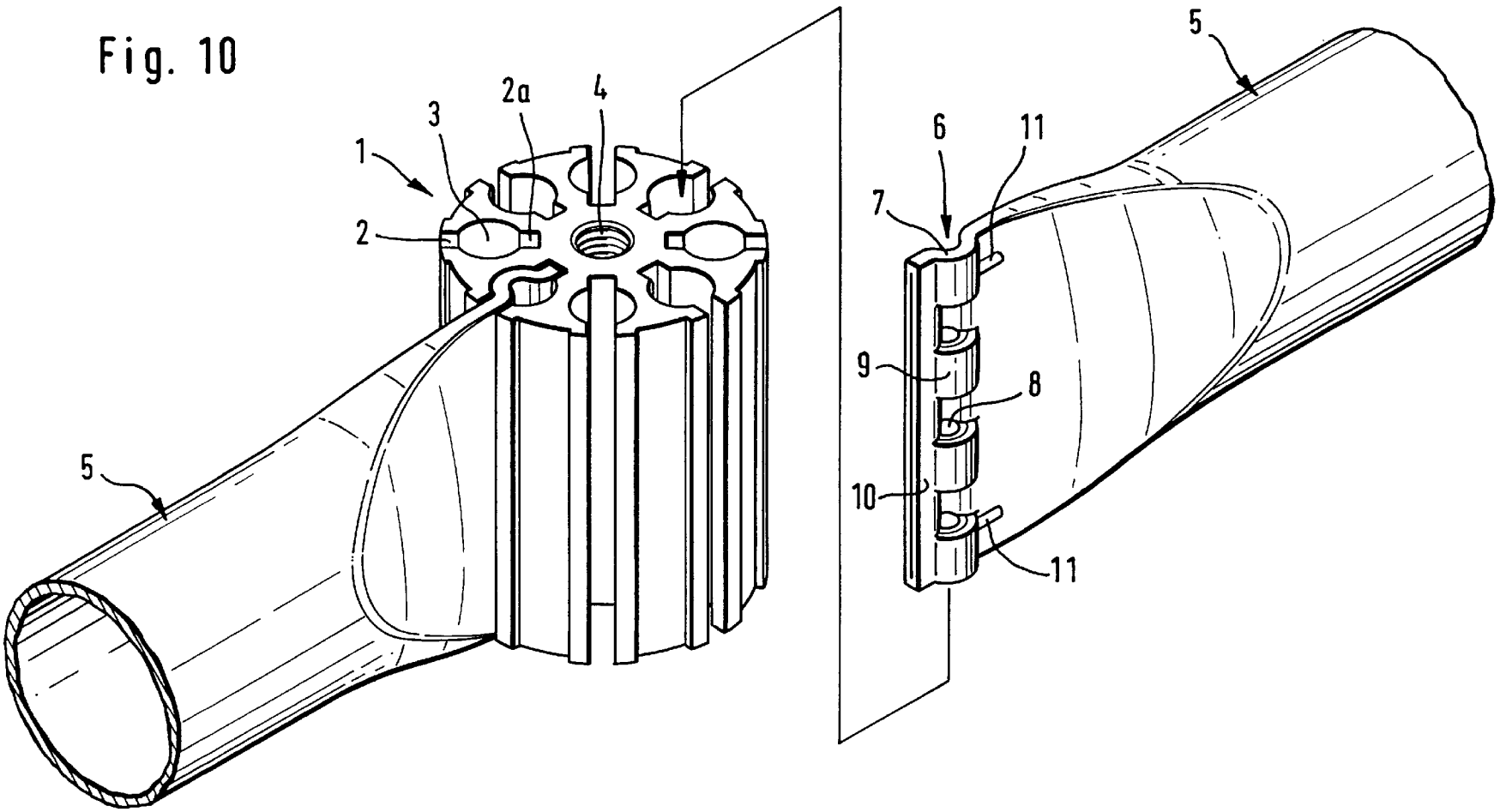
Figure 11:
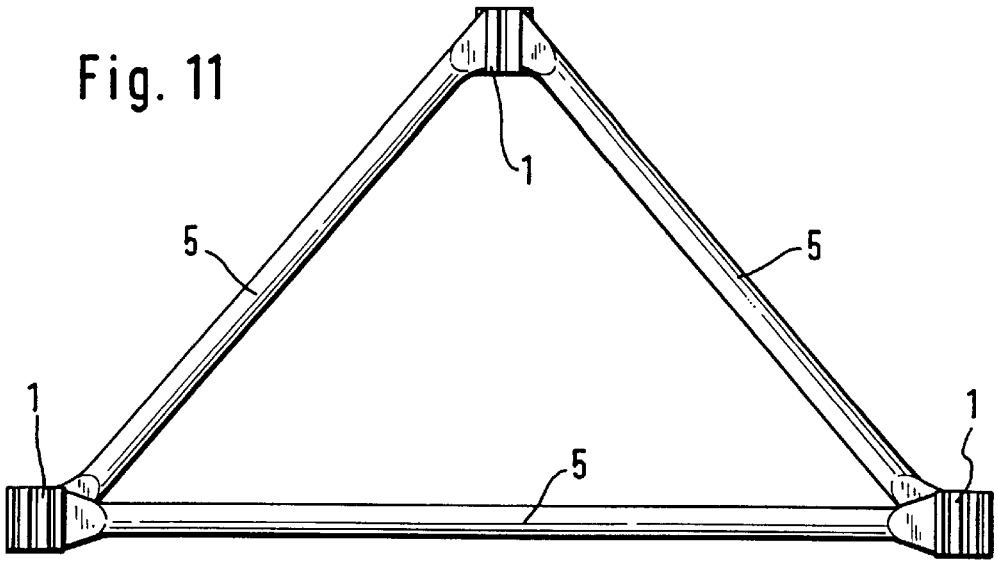
Figure 12:
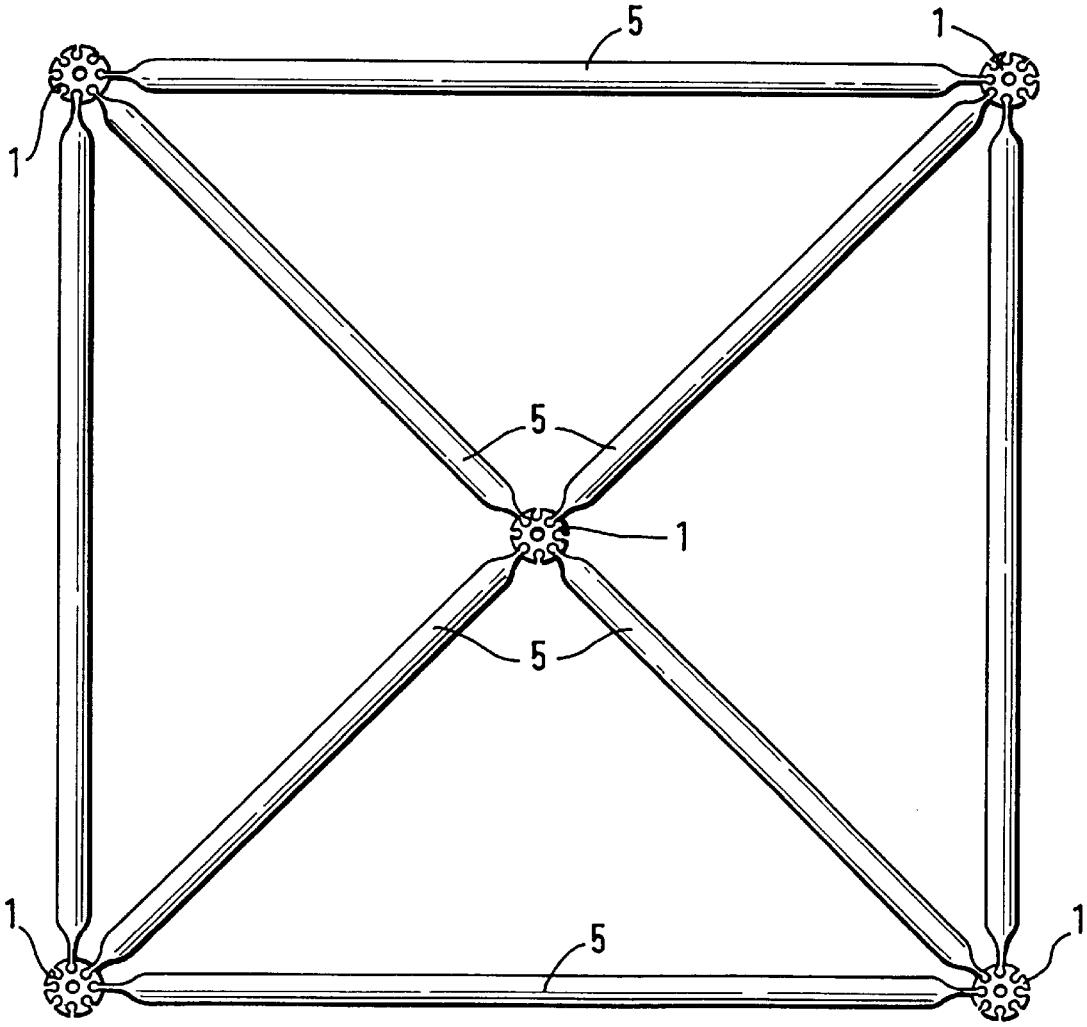

FIG. 3 shows the supporting bar of FIG. 2 turned through an angle of 90° around the longitudinal axis, FIG. 4 shows a section along line A-B of FIG. 3, FIG. 5 shows a section along line C-D of FIG. 3, FIG. 6 shows an elevational view of another embodiment of a supporting bar, which may be used as a so-called diagonal bar in supporting structures, FIG. 7 shows the supporting bar represented in FIG. 6 turned through 90° along the longitudinal axis, FIG. 8 shows a section along line A-B of the FIG. 7, FIG. 9 shows a top view of a partial assembly of two supporting bars of FIG. 2 and a connection element of FIG. 1, FIG. 10 shows a partially exploded perspective view of the partial assembly of FIG. 9, FIG. 11 shows an elevational view of an assembly of three connecting elements of FIG. 1, a supporting bar of FIG. 2, and two supporting bars of FIG. 6, and FIG. 12 shows a top view of an assembly of five connecting elements of FIG. 1, four supporting bars of FIG. 2, and four supporting bars of FIG. 6.

FIG. 1 shows a cross section through the connecting element 1.

The cylindrical connecting elements 1 have the cross section represented and are axially as long as the width of the flat ends of the supporting bars which are to be connected to one another by the connecting elements 1. A plurality of slots 2, 2*a* which are open on one side and are distributed in a rotationally symmetrical manner extend from the surface to the center of the cylinder, from one end face to the other end face of said cylinder. Eight slots 2 are provided in the example of FIG. 1. The width of the slots 2 is somewhat larger than the thickness of the flat ends of the supporting bars. The slots 2 are each widened, at a distance from the radial ends of the same, to form approximately cylindrical chambers 3 which extend, parallel to the axis of the cylinder, from one end face to the other end face. The center axes of the chambers 3 are preferably located on a circle around the center of the cylindrical connecting element 1. However, it is also possible to form different connecting elements 1 in which the center axes of the chambers are located on circles with slightly different diameters, depending on whether the connecting element is intended to be subjected to tensile or compressive loading. if it is to be subjected to tensile loading, the diameter should be smaller than for a connecting element which is subjected to compressive loading. The diameter of the chambers 3 corresponds approximately to the external diameter of the thickening with annular cross section formed in the end region of the supporting bars. The diameters correspond to one another such that the insertion heads of the supporting bars can easily be inserted into the slots 2, provided with chambers 3, of the connecting elements 1, but nevertheless a certain form fit is achieved which is sufficient to retain the supporting bars on the connecting element 1. Extending the slots 2, 2*a* in the radial direction beyond the chambers 3, the ends of the slots nevertheless being spaced apart from the center axis of the connecting elements 1 by such a distance that the strength of the elements 1 is not adversely affected, has the advantage of correspondingly formed insertion heads 6 on the supporting bars being able to engage as far as these slot regions 2*a* and of better guidance of the insertion heads in the connecting elements 1 being achieved.

The connecting elements 1 may have a central bore 4. There may be an internal thread, preferably starting from the end faces, over part of the central bore 4, but not throughout said central bore 4. The thread serves for the engagement of screws in order for it to be possible to fasten, on the end faces of the connecting elements 1, covering plates which close the ends of the slots and of the chambers 3 at the end faces of the connecting elements.

The connecting elements 1 may be produced from drawn metal profiles, by cutting the latter to the desired length. The height of the cylindrical connecting elements 1 coincides with the width of the flat ends of the supporting bars.

FIG. 2 shows a section of a supporting bar 5 with insertion heads 6, formed in the region of the two flat ends, for engagement in slots, provided with chambers, of the connecting elements. In order to form the insertion heads 6, at least two, preferably up to six, parallel slits are provided at the flat ends of the supporting bars 5, at a distance from the end edges, at an angle of 90° with respect to the end edge, this resulting in at least three, preferably up to seven, strips 9 located one beside the other in the region of the flat ends, at a distance from the end edges. In each case one bead 7 running parallel to the end side is made in the strips 9, at a distance from the end edges.

The hemispherical or oval stamped sections formed by the beads 7 are respectively formed on mutually opposite sides in adjacent strips 9 in order to form, parallel to the end side of the flat ends of the supporting bars 5, a cross sectionally annular thickening whose outer circumference corresponds with the inner circumference of the chambers in the slots of the connecting elements. The annular thickening, which extends over the width of the flat ends of the supporting bars 5, has an outer surface which is interrupted in each strip on one side. Once the insertion head 6 has been inserted into a connecting element, it is possible, in order to reinforce the form-fit engagement, to insert a pin (not shown) into the duct 8 formed by the beads 7, the external diameter of this pin being slightly larger than the internal diameter of the duct 8.

The continuous border strip 10 of the insertion heads 6 which remains in each case on the end edges of the flat ends of the supporting bars 5 engages in the region between the chambers 3 and the inner ends of the slots 2 when the insertion heads 6 are inserted into the slots 2*a* of the connecting elements.

FIG. 3 shows, in plan view, the supporting bar 5 shown in FIG. 2 turned through 90° around the longitudinal axis. The insertion heads 6 are formed at both ends. It is possible to see the arrangement of the beads formed from the strips 9 in the region adjoining the continuous border strip 10. In the case of this embodiment of the supporting bars 5, which are used as so called two-dimensional bars in supporting structures, the cross sectionally annular thickening runs at an angle of 90° with respect to the longitudinal axis of the supporting bars 5. In order to strengthen the flat ends of the supporting bars 5, one or more beads 11 running at an angle of 90° with respect to the end edge of the supporting bars 5 may be provided in the region of the flat ends, between the thickening with annular cross section and that end of the flat region which is remote from the end edge. In the case of the supporting bar 5 shown in FIG. 3, these beads 11 run parallel to the longitudinal axis of the supporting bar 5.

FIG. 4 is a section along line A-B of FIG. 3, for the purpose of illustrating the formation of the beads 7 of adjacent strips 9 respectively on mutually opposite sides.

FIG. 5 is a section along line C-D of FIG. 3 and shows the beads 11 for strengthening this region of the flat ends.

FIG. 6 shows a section through another embodiment of a supporting bar 5, which is intended to be used as a so-called three-dimensional diagonal bar in supporting structures. In the case of this embodiment, the axes of the insertion heads 6 run at an angle $\alpha$ other than 90° with respect to the longitudinal axis of the supporting bar 5, as can be seen from FIG. 7.

In the same manner as in FIG. 2, the insertion heads 6 have beads 7 which are formed, in individual sections (strips 9), in mutually opposite directions, to form the beads or the thickening with annular cross section and duct 8. Once the beads 7 have been formed, a continuous border strip 10 still remains in each case on the end edges of the flat ends of the supporting bar 5.

FIG. 7 shows the supporting bar 5 represented in FIG. 6 turned through 90° around the longitudinal axis, so that it is possible to see the insertion heads 6 arranged parallel to one another at the two ends of the supporting bar 5 as well as their alignment with respect to the longitudinal axis of the supporting bar. The angle $\alpha$ of the longitudinal axis of the insertion heads, in particular of the thickening, formed from the beads 7, with annular cross section, may be from 55° to 45° with respect to the longitudinal axis of the supporting bar 5, in the example shown it is 90°.

The insertion heads likewise have the continuous border strip 10.

FIG. 7 represents an embodiment of a supporting bar 5 in which the flat end region is likewise strengthened by beads 11 between the bead 7 and that end of the flat ends which is remote from the end edge.

FIG. 8 is a section along A-B of FIG. 7 and shows the formation of the beads 7 on mutually opposite sides for adjacent strips 9.

The supporting bars 5 represented in FIGS. 2 to 8 are preferably produced from tubes whose respective end regions have been pressed flat in order to be able to form the insertion heads 6. However, it is also possible, in principle, to produce supporting bars with flat end regions and with insertion heads from solid material.

LIST OF DESIGNATIONS

1 Connecting element
2, 2*a* Slots
3 Cylindrical chamber
4 Central bore
5 Supporting bar
6 Insertion head
7 Bead
8 Duct
9 Strip
10 Border strip
11 Bead

I claim:

1. A construction set for use in forming supporting structures, said construction set comprising:

a cylindrical connecting element having a central axis and an outer cylindrical surface, said connecting element including a plurality of slots which are parallel to said central axis, said slots extending radially inwardly from said outer surface to said central axis, each said slot including a widened portion intermediate said outer surface and said central axis and defining a chamber;

a support bar, said support bar having flattened ends, said flattened ends each including an insertion head and an edge which defines the outer limits of said flattened end, each said insertion head including two slits which are spaced from said edge and which are disposed parallel to each other and at 90 degrees relative to said edge, said slits defining a plurality of strips, each said strip defining a bead, the beads of adjacent said strips disposed on mutually opposite sides of a central plane through the longitudinal axis of said support bar, said beads defining a thickened portion having a cross-sectional shape similar to the cross-sectional shape of said chambers, whereby said insertion heads are adapted to be received in said chambers.

2. The construction set according to claim 1 wherein each insertion head includes from three to seven strips.

3. The construction set according to claim 1 wherein the cross-sectional shape of said chambers is one of a circular shape and an oval shape.

4. The construction set according to claim 1 including a second bead disposed in each said flattened ends, said second beads disposed at substantially 90 degrees to said edges.

5. The construction set according to claim 1 wherein each said chamber defines a first axis and each said thickened portion defines a second axis which is spaced away from said edge whereby said thickened portion defines a border strip, the distance from each said second axis to said associated edge being smaller than the distance from each said first axis to the radially inner end of said associated slot.

6. The construction set according to claim 1 wherein said beads form a duct adapted for receiving a pin.

7. The construction set according to claim 5 wherein the second axes are disposed at 90 degrees to the longitudinal axis of the associated support bars.

8. The construction set according to claim 5 wherein the second axes are disposed parallel to one another and at an angle in the range of 45 degrees to 55 degrees with respect to the longitudinal axis of the associated support bars.

9. The construction set according to claim 1 wherein said connecting element includes eight slots arranged in a circle centered on the central axis.

10. The construction set according to claim 1 wherein said connecting element includes outer end faces, said slots open at said end faces, said connecting end including means for securing a disk to close the ends of said slots at said end faces.

* * * * *

UNITED STATES PATENT AND TRADEMARK OFFICE

CERTIFICATE OF CORRECTION

PATENT NO. : 5,802,798

DATED : September 8, 1998

INVENTOR(S) : Christian Martens

It is certified that error appears in the above-identified patent and that said Letters Patent is hereby corrected as shown below:

Claim 1, Col. 6, Line 41 after "chamber" insert --,said chamber having a cross sectional shape--.
Claim 1, Col. 6, Line 42 after "bar," insert --said support bar having a longitudinal axis,--.
Claim 1, Col. 6, Line 44 delete "the" and insert --an--.
Claim 1, Col. 6, Line 44 delete "limits" and insert --limit--.
Claim 1, Col. 6, Line 55 delete "adapted to be".
Claim 5, Col. 7, Line 3 delete second "said" and insert --an--.
Claim 5, Col. 7, Line 4 delete "edge" and insert --one of said edges--.
Claim 5, Col. 7, Line 5 delete "the" and insert --a--.
Claim 5, Col. 7, Line 5 delete second "said" and insert --an--.
Claim 5, Col. 7, Line 5 delete "slot" and insert --one of said slots--.
Claim 7, Col. 7, Line 8 after "wherein" insert --each of--.
Claim 7, Col. 7, Line 10 delete "the" and insert --an--.
Claim 7, Col. 7, Line 10 after "associated" insert --one of said--.
Claim 8, Col. 7, Line 11 after "wherein" insert --each of--.
Claim 8, Col. 8, Line 2 delete "the" and insert --an--.
Claim 8, Col. 8, Line 2 after "associated" insert --one of said--.
Claim 10, Col. 8, Line 9 delete "the ends of".

Signed and Sealed this

Sixteenth Day of March, 1999

*Attest:*

Q. TODD DICKINSON

*Attesting Officer*

*Acting Commissioner of Patents and Trademarks*